US006145264A

United States Patent [19]

Dallaire

[11] Patent Number: 6,145,264

[45] Date of Patent: Nov. 14, 2000

[54] BRACKET FOR SUSPENDED CEILING TILES

[76] Inventor: Michel Dallaire, 4062 avenue Wilson, Montréal, Quebec H4A 2T9, Canada

[21] Appl. No.: 09/240,875

[22] Filed: Feb. 1, 1999

[51] Int. Cl.[7] ..... E04B 9/22

[52] U.S. Cl. ..... 52/526.05; 52/127.9; 52/489.1; 52/489.2; 52/768; 52/769; 52/526.07; 52/506.08; 52/698; 248/214

[58] Field of Search ..... 52/127.8, 127.9, 52/127.12, 489.1, 489.2, 767, 768, 769, 506.05, 506.08, 698, 506.07; 248/214

[56] References Cited

U.S. PATENT DOCUMENTS

| | | |
|---|---|---|
| 1,879,778 | 9/1932 | Venzie . |
| 1,891,512 | 12/1932 | Venzie . |
| 3,276,179 | 10/1966 | Rallis . |
| 3,303,624 | 2/1967 | Swain . |
| 3,828,508 | 8/1974 | Moeller . |
| 5,189,858 | 3/1993 | Jonanet . |

*Primary Examiner*—Robert Canfield

*Attorney, Agent, or Firm*—F. Martineau

[57] ABSTRACT

A number of ceiling rails are installed under the structural ceiling of a room in a selected array, in a configuration to provide openings between the rails to fit therein ceiling tiles. Brackets are used to support the tiles, the brackets being removably attached to the rails. At least one bracket is used on each side of a tile. The bracket comprises a pair of slots that allow it to be snapped onto the rail, and has a pair of integral laterally projecting load-bearing plates which support a first tile on one side and a pivotable supporting finger which can support a second tile on its opposite side. The pivotable finger pivots between an inoperative position in which is extends along the length of the bracket without laterally projecting therefrom, and an operative position in which it laterally projects beyond the side edge of the bracket. In this operative position, it may support a ceiling tile. A coil spring continuously biases the finger towards its operative position, while a spring blade catch prevents it from being pivoted into its operative position, until a tile to be supported by the finger is pushed by a work person to abut against the catch and releases the finger into pivotal displacement, towards its operative position, in which it will support the tile abutting against the catch.

13 Claims, 4 Drawing Sheets

BRACKET FOR SUSPENDED CEILING TILES

FIELD OF THE INVENTION

The present invention relates to suspended ceilings, and more particularly to a bracket for suspended ceiling tiles.

BACKGROUND OF THE INVENTION

It is known to provide a plurality of removable ceiling tiles which are installed in adjacent fashion as an aesthetic ceiling spacedly underneath the structural ceiling of a room, whereby the aesthetic ceiling does not support any structural load. Water conduits, electrical wires and other miscellaneous building equipment can be located between the aesthetic ceiling tiles and the structural ceiling, without being apparent from the room per se. Light material, such as electric or phone wires or the like, can even be supported by the aesthetic ceiling tiles.

To support the ceiling tiles, an array of perpendicular thin metallic or plastic rails is often used, with a number of rectangular openings being defined between the rails to receive the tiles. Each tile is thus supported by gravity on its four sides by the rails, with each rail having a pair of parallel adjacent horizontal flat load-bearing elongated side legs to peripherally support the tiles. The rails downwardly depend from the structural room ceiling and are attached thereto by metallic wire or the like.

To install a tile on the rails, it must be inserted through an opening between the rails and then rotated and tilted so that it comes to rest on the load-bearing rails. Likewise, to remove a tile from the rails, the tile must be manually lifted to disengage the rails, and then rotated and tilted so that it may be passed through its opening. However, this is often much more complex than it may seem, since there are often a large number of wires and miscellaneous gear over the ceiling tiles, including light casings, air ducts, phone and electric wires, etc . . . . Thus, the space required to rotate and tilt the ceiling tile often lacks, and the tile must be forced through its opening by slightly resiliently deforming the tile and sliding it through the surrounding rails. Since these tiles are often made of semi-rigid cardboard-like material, it is only very slightly flexible, and the removal/installation operations effectively result in damaging the fragile tile due to its frictional sliding engagement against the surrounding rails.

Another disadvantage of these suspended ceiling rails and tiles is that it is difficult to modify the already installed suspended ceiling configuration, such as in showrooms or the like wherein the ceiling configuration can be modified rather frequently. This is especially true in the case of irregular suspended ceiling configurations, where the ceiling is curved so as to present original aesthetic configurations.

OBJECT OF THE INVENTION

It is the gist of the present invention to provide a bracket for supporting aesthetic ceiling tiles that allows easy removal and installation of the tiles.

SUMMARY OF THE INVENTION

The present invention relates to a bracket for suspended ceiling tiles.

More particularly, the invention relates to a bracket for removable attachment to an elongated fixed ceiling rail having opposite longitudinal sides and for supporting the edges of a first and a second adjacent ceiling tiles, said bracket comprising:

a main body having opposite upper and lower surfaces and a first and a second opposite sides;

an attachment device located on said main body upper surface, for removable attachment of said bracket to the rail so that said main body first and second sides be located on opposite longitudinal sides of the rail;

a load-bearing surface integral to said main body and laterally extending beyond said first side thereof, for supporting the first ceiling tile;

a movable load-bearing finger; and a mounting device attaching said movable finger to said bracket main body and allowing relative displacement of said finger between an inoperative position, in which said finger laterally extends short of said main body second side, and an operative supporting position, in which said finger laterally extends beyond said second side for supporting the second ceiling tile.

Preferably, the bracket further comprises:

a first biasing device mounted on said main body, for continuously biasing said finger towards said operative position;

a catch mounted on said main body and movable between a first position in which said catch engages and prevents said finger from moving towards its said operative position, and a second position in which said catch allows said finger to be moved towards its said operative position under the bias of said first biasing device;

a second biasing device mounted on said main body and continuously biasing said catch towards its said first position;

whereby said catch can be forcibly moved from its first position to its second position against the bias of said second biasing device, for releasing said finger into a displacement towards its operative position.

The invention also relates to a bracket for removable attachment to an elongated fixed ceiling rail having opposite longitudinal sides and for supporting the edges of a first and a second adjacent ceiling tiles, said bracket comprising:

a main body having opposite upper and lower surfaces and defining a first and a second opposite sides;

an attachment device located on said main body upper surface, for removable attachment of said bracket to the rail so that said main body first and second sides be located on opposite longitudinal sides of the rail;

a load-bearing surface integral to said main body and laterally extending beyond said first side thereof, for supporting the first ceiling tile;

a pivotable load-bearing finger coplanar with said load-bearing surface and pivotable on said main body between an inoperative position, in which said finger laterally extends short of said main body second side, and an operative supporting position, in which said finger laterally extends beyond said main body second side for supporting the second ceiling tile;

a first biasing device mounted on said main body and continuously biasing said finger towards its operative position;

a catch mounted on said main body and movable between a first position in which said catch engages and prevents said finger from moving towards its said operative position and a second position in which said catch allows said finger to be moved towards its said operative position under the bias of said biasing device; and a second biasing device mounted on said main body and continuously biasing said catch towards its said first position;

whereby said catch can be forcibly moved from its first position to its second position against the bias of said second biasing device, for releasing said finger into a pivotal displacement towards its operative position under the bias of said first biasing device.

DETAILED DESCRIPTION OF THE EMBODIMENT

FIGS. 1–4 show a bracket 10 according to the invention. Bracket 10 comprises a substantially flat and rectangular main body 12 defining first and second opposite ends 12*a*, 12*b*, first and second opposite sides 12*c*, 12*d* and an upper and a lower opposite surfaces 12*e*, 12*f*.

Figure 1:
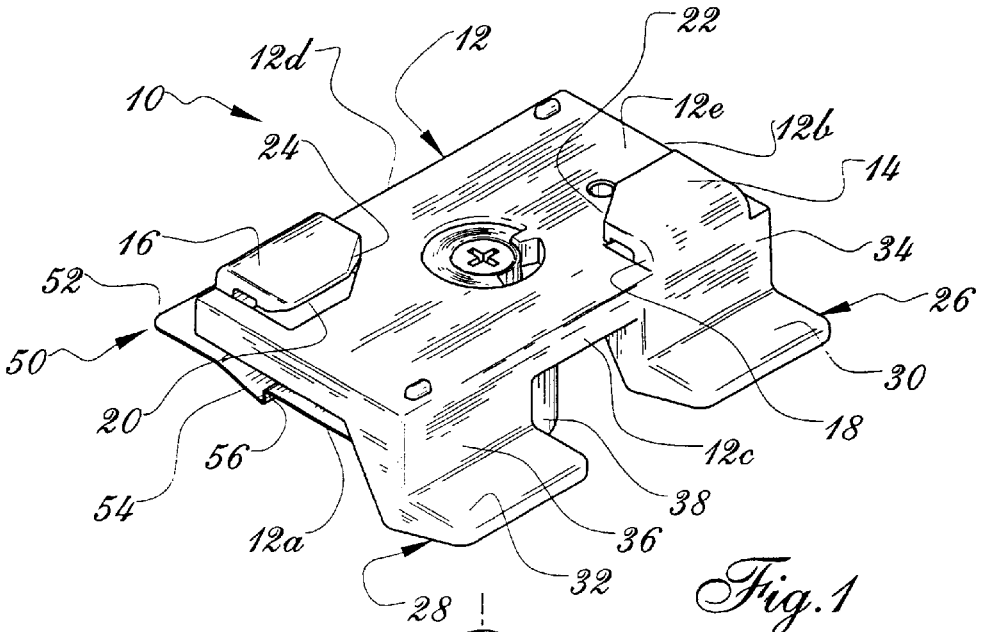
FIG. 1 is a top perspective view of the tile-supporting bracket of the invention.

Main body 12 comprises, on its upper surface 12*e*, a pair of upwardly oriented lips 14, 16 located on opposite sides and opposite ends of main body 12, i.e. lip 14 is located along first side 12*c* near second end 12*b* and lip 16 is located along second side 12*d* near first end 12*a*. Lips 14, 16 could be located on any of the two pairs of opposite corners thus defined, i.e. they could alternately be located as follows: lip 14 could be located along second side 12*d* near second end 12*b*, while lip 16 would then be located along first side 12*c* near first end 12*a*. Lips 14, 16 form inwardly oriented elbowed plates which come into close parallel relation with the main body upper surface 12*e*, so as to define slots 18, 20 between lips 14, 16 and upper surface 12*e*. Lips 14, 16 further have truncated inner corners 22, 24 (FIG. 1). As shown, an opening can be formed in register with lips 14, 16 in main body 12, to increase the flexibility of lips 14, 16.

Bracket 10 comprises an integral load-bearing surface which includes two longitudinally spaced-apart laterally outwardly-extending fingers 26, 28 downwardly depending from main body 12 along its first side 12*c*. It is understood, however, that the load-bearing surface could alternately be made of a single uninterrupted surface instead of two spaced-apart fingers. Fingers 26, 28 have flat coplanar upper surfaces 30, 32 and vertical walls 34, 36 which integrally link them to main body 12.

Figure 2:
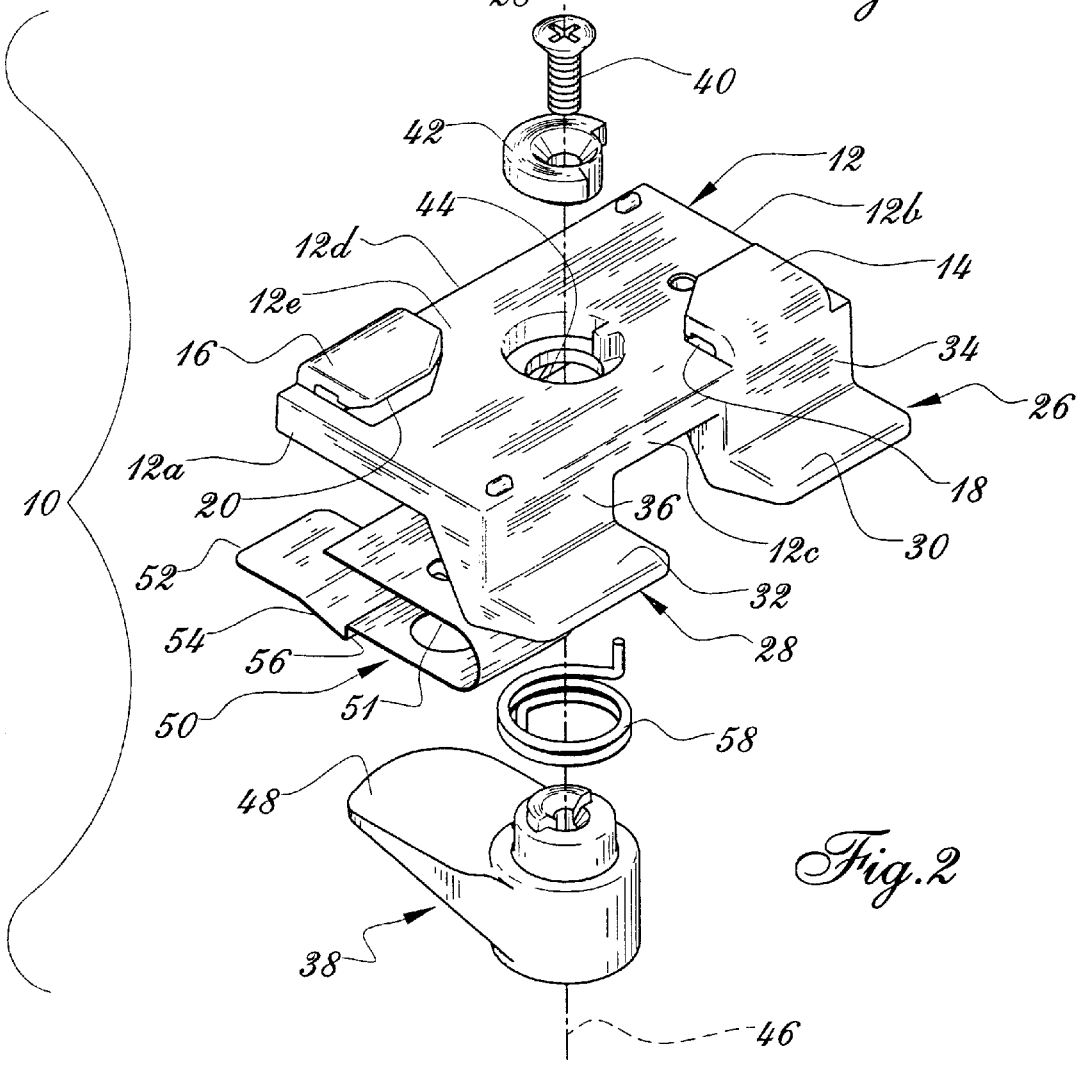
FIG. 2 is an exploded top perspective view of the bracket of FIG. 1.
Figure 3:
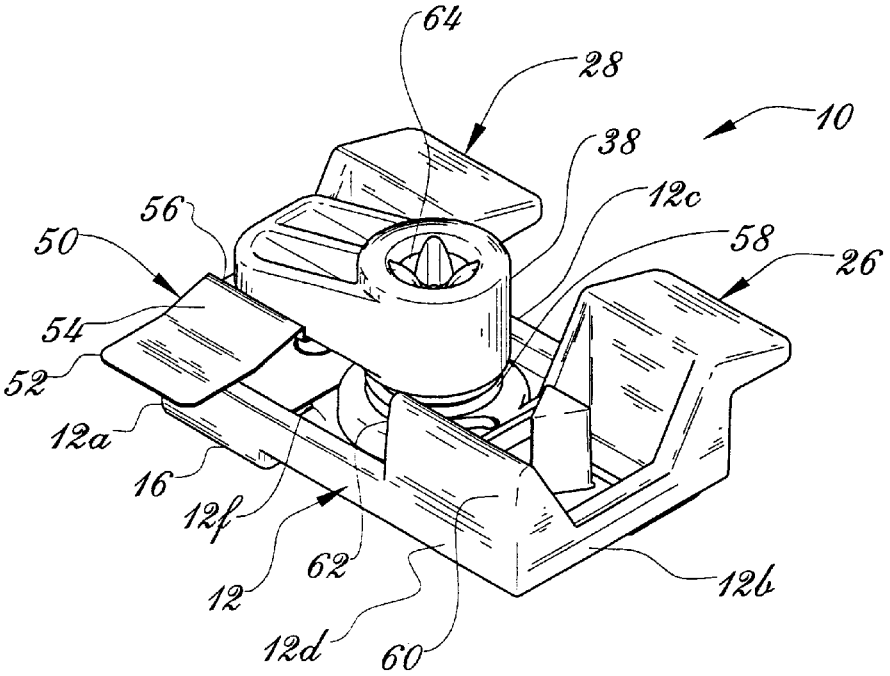
FIGS. 3 and 4 are bottom perspective views of the bracket of the invention, sequentially showing the pivotable supporting finger in an inoperative position and in an operative tile-supporting position.
Figure 4:
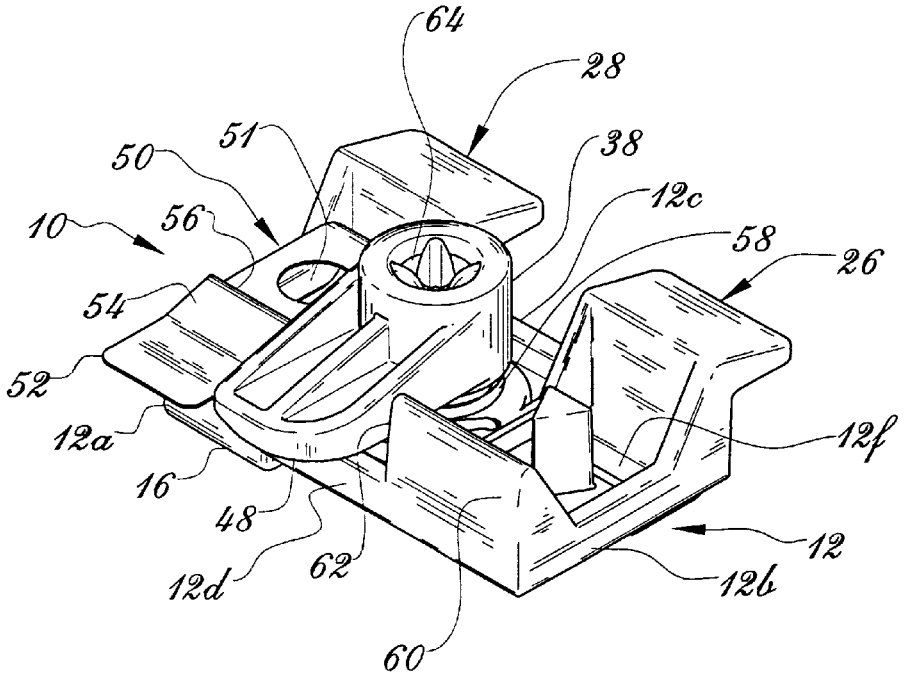

To the main body lower surface 12*f* is pivotally attached a load-bearing pivotable finger 38 at or near the center of main body 12. FIG. 2 more particularly shows that a screw 40 and washer 42 engage a complementary bore 44 made through the main body 12 and threadingly engages the finger 38 at its pivotal axis 46. Finger 38 comprises an elongated outer free end 48 which rotates about axis 46 and which has a flat upper surface.

A U-shaped spring blade catch 50 is attached at its first catch end 51 on the main body lower surface 12*f* at or near main body first end 12*a*. Spring blade 50 has an intrinsic resiliency which, in combination with its elbowed shape, allows its second laterally outer free end 52, which laterally extends beyond the main body second side 12*d*, to bend so as to be vertically movable relative to its attached portion 51. Spring blade 50 further comprises an upwardly outwardly inclined surface 54 near outer free end 52 and a notch 56 adjacent surface 54.

Bracket 10 further comprises a coil torsion spring 58 located coaxially with axis 46 and attached to the main body lower surface 12*f* and to pivotable finger 38, coil spring 58 continuously biasing pivotable finger 58 from its inoperative limit position (FIG. 3), in which it longitudinally extends along main body 12 towards first end 12*a* without laterally protruding beyond second side 12*d*; towards its operative limit position (FIGS. 1, 2 and 4), in which it laterally extends beyond the main body second side 12*d* in a substantially perpendicular fashion relative thereto. Finger 58 is prevented from being pivoted beyond its operative position by means of a downward projection 60 having an abutment surface 62 registering with the operative position of finger 58 and on which finger 58 abuts in its operative position.

Figure 5:
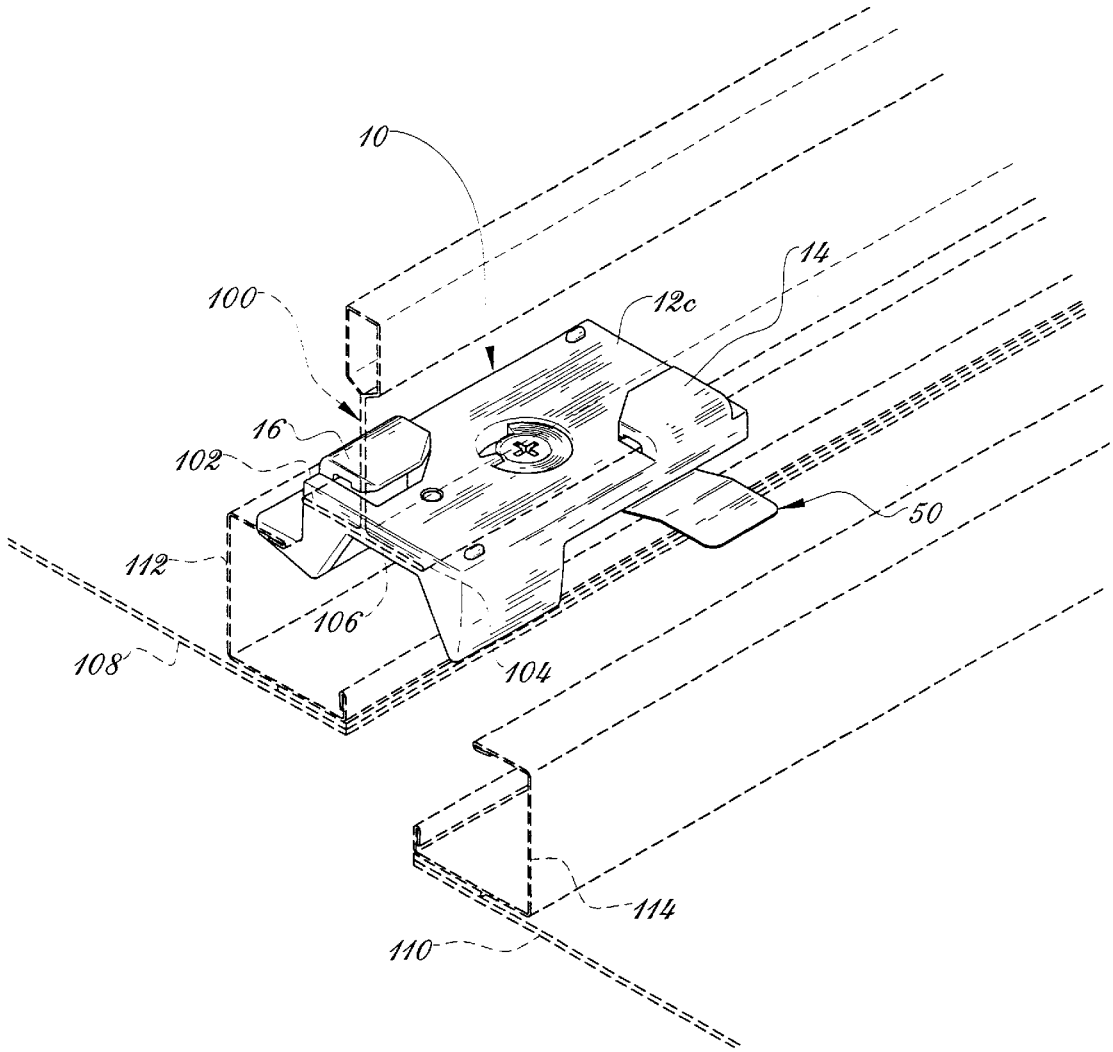
FIG. 5 is a top perspective view of the bracket of the invention, partly showing in dotted lines the rail on which the bracket is installed, a first tile supported by the bracket and a second tile to be installed on the bracket.

In use, and as suggested in FIG. 5, bracket 10 is to be installed on a cross-sectionally T-shaped ceiling rail 100 which is attached to the structural ceiling of a room in a known manner. Rail 100 has a pair of opposite coextensive side legs 102, 104 both forming a lower surface 106. To accomplish the attachment of bracket 10 to rail 100, bracket 10 is applied with its upper surface 12*e* against the lower flat surface 106 of T-shaped rail 100, and bracket 10 is tilted diagonally so that the rail side legs 102, 104 extend between lips 14, 16, with the truncated comers 22, 24 facilitating the insertion of legs 102, 104 between lips 14, 16. Bracket 10 is then flatly rotated into a longitudinally parallel relationship with rail 100, lips 14, 16 resiliently snapping themselves onto slide legs 104, 102 respectively. Thus, with a simple wrist rotational motion, it is possible for a person to manually engage/disengage bracket 10 onto/from rail 100.

Figure 6:
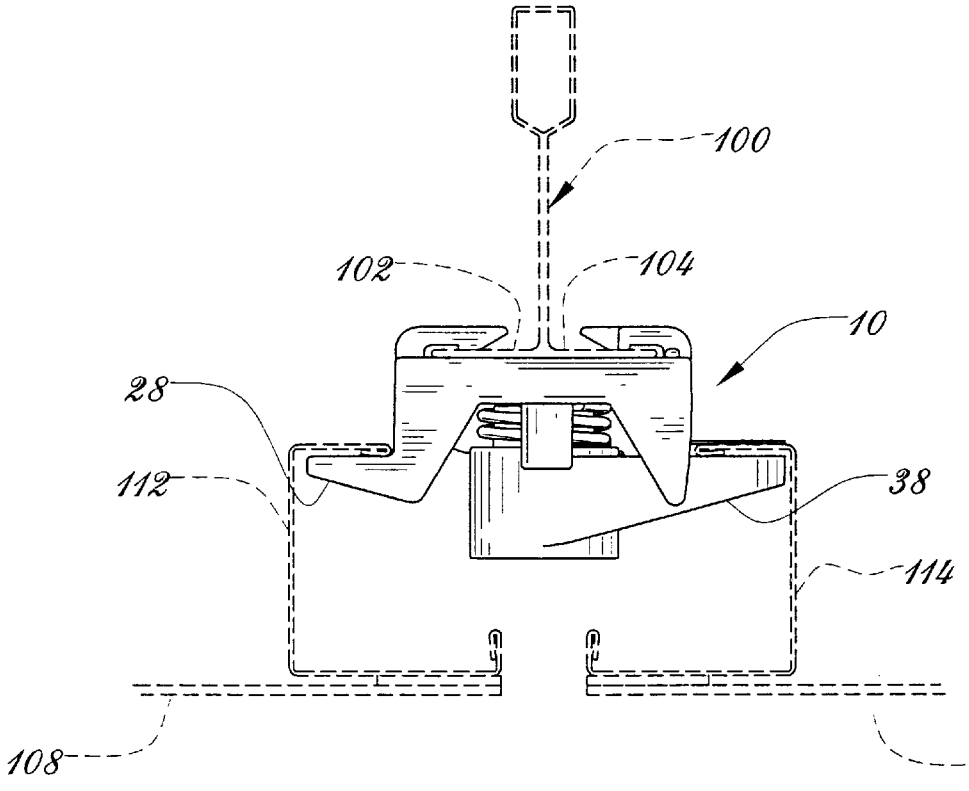
FIG. 6 is an end elevation of the bracket of the invention together with a ceiling rail, shown cross-sectionally in dotted lines and supporting the bracket, and a pair of adjacent ceiling tiles, cross-sectionally shown in dotted lines and supported on opposite sides of the bracket.

As shown in FIGS. 5 and 6, bracket 100 is especially, though not exclusively, designed to support two adjacent ceiling tiles 108, 110 of the type having upper cross-sectionally C-shaped support frames 112, 114 along two parallel edges thereof, preferably the longitudinal edges of rectangular ceiling tiles such as tiles 108, 110. Indeed, once bracket 10 is installed as described hereinabove on the ceiling rail 100, the upper free leg of the C-shaped frame 112 of the first ceiling tile 108 can be positioned so as to vertically rest onto the flat surfaces 30, 32 of integral fingers 26, 28, with the tile 108 laterally abutting against the vertical side walls 34, 36 of fingers 26, 28 to prevent accidental lateral diplacement of tile 108. On the other side of bracket 10, tile 110 can be supported by bracket 10 by lifting tile 110 until the upper portion of C-shaped frame 114 comes into upward vertical abutment against spring blade catch 50. The spring blade 50, due to its own intrinsic resiliency, is then allowed to be vertically forcibly moved from a first position—in which the spring blade notch 56 prevents pivotable finger 38 from pivoting outwardly under the bias of coil spring 58—to a second position—in which it is vertically raised so that finger 38 be released by notch 56 so as to pivot under the bias of coil spring 58 into its operative position. Thus, by applying upward vertical pressure on the outer free end 52 of blade catch 50 with the upper free leg of the C-shaped tile frame 114, pivotable finger 38 is released and pivots into its laterally projecting operative position, with its upper surface 48 being located under the upper edge of frame 114 so as to support same. Thus, tile 110 can be supported by finger 38, as shown in FIG. 6. Downward projection 60 prevents tile 110 from accidental displacement by the lateral abutment of tile 110 thereon.

It is understood that several brackets 10 need to be used to support a single tile, such as tile 108. Indeed, preferably two pairs of brackets 10 are used, one pair to support each opposite longitudinal side edge portion of a rectangular ceiling tile. The brackets 10 of the first pair, which are attached on a same rail, are oriented so that they both have their integral fingers 26, 28 protruding inwardly into the opening between the rails, where the tile is to be installed. On the opposite adjacent rail, the two brackets 10 of the second pair have the outer free ends 52 of their spring blades 50 projecting inwardly into the opening between the rails. To install the ceiling tile, the first longitudinal side edge of the tile frame is vertically rested onto the fingers 24, 26 of the first pair of brackets 10. The second longitudinal side edge of the tile frame is then raised against the two catch blades of the second pair of brackets 10, which release the pivotable fingers 38 of the two brackets 10 into their operative tile-supporting position, so that the two load-bearing pivotable fingers 38 underlie and support the side edge of the ceiling tile frame.

Figure 7:
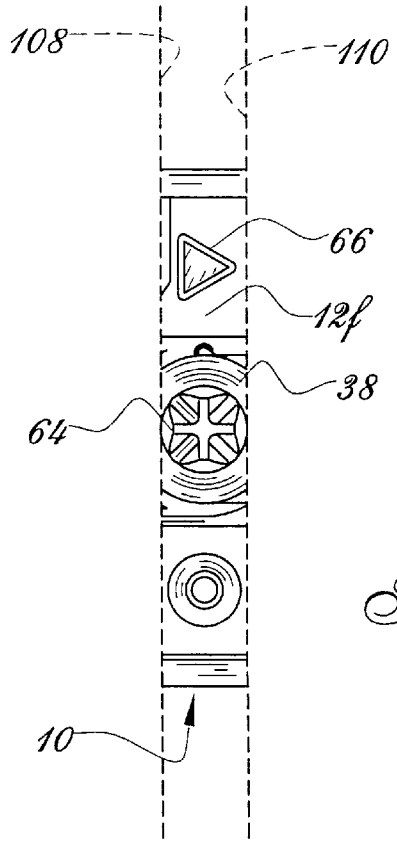
FIG. 7 is a bottom plan view of the exposed section of the bracket of the invention, partially hidden by the laterally adjacent tiles supported thereby, with the edges of the tiles being partly illustrated in dotted lines.

Once the ceiling tiles are installed, a small gap exists between two adjacent tiles 108, 110, as suggested in FIG. 7. Thus, the central portion of the lower surface of bracket 10 can be seen and accessed through this gap. It is possible to reach, e.g. with a screwdriver having a proper head complementary with an axial bore 64 made in the rotating body of pivotable finger 38, into bore 64 and rotate finger 38 against the bias of coil spring 58 from its operative supporting position into its inoperative position. During this pivotal displacement, finger 38 slides against the inclined surface 54 of spring blade 50 to upwardly bias same into its second position, so that finger 38 may slide beyond notch 56. At this point, the intrinsic resiliency of blade 50 will bias same into its first limit position, in which it will abut against finger 38 with notch 56 laterally preventing finger 38 from pivoting into its operative position under the bias of coil spring 58. Thus, by removing pivotable finger 38, the ceiling tile is released.

A visual arrow marker 66 is located on the bracket main body lower surface **12*f* to point in the direction in which the pivotable finger 38 extends, so that the person forcibly pivoting finger 38** back into its inoperative position knows in which direction to rotate same.

Any minor variations which do not deviate from the scope of the present invention, are considered to be included therein as alternate embodiments.

For example, although the attachment device of bracket 10 to the ceiling rail, including the inturned upper lips 14, 16, is the preferred way to carry out the invention, other attachment devices could be envisioned, e.g. different snapping arms, bolts, glue, or any other suitable means. It is highly preferable, however, that the attachment device allow selective removal of the bracket from the ceiling rail.

Also, the catch spring blade 50 could be replaced by another suitable latch and spring member, such as a hinged plate including a coil compression spring.

The biasing devices, be it the spring blade 50 or the coil spring 58, could be replaced by other suitable biasing means, such as torsion springs, compression springs, or alternately configured spring blades or another catch member made from a material with a spring-back effect.

It could be envisioned that the load-bearing pivotable finger 38 be replaced by a finger having a translational movement instead of a pivoting movement, with the bracket 10 then being modified to suit this new design.

Although it has been described that the bracket 10 is especially suitable for use with rectangular tiles having longitudinal C-shaped frames attached thereover, it is understood that the bracket could be used to support directly the side edge portion of the tiles, even if no C-shaped frame is present on this side edge portion. Slight modifications to the bracket 10 could be accomplished to adapt it for use in supporting the side edges of the tiles, and more particularly the thickness of the spring blade catch 50 should be increased to accomodate the tile thickness which is likely to be greater than the C-shaped sheet frame thickness.

Finally, the bracket of the invention has been described and shown in the drawings as being of generally rectangular shape, but it must be understood that it could be of any other suitable shape, e.g. square, polygonal, or made from a partially empty frame. Accordingly, the definitions of the first and second sides, first and second ends and upper and lower surfaces should be read as corresponding to associated orientations on a bracket of a different shape.

I claim:

1. A bracket for removable attachment to an elongated fixed ceiling rail having opposite longitudinal sides and for supporting the edges of a first and a second adjacent ceiling tiles, said bracket comprising:

a main body having opposite upper and lower surfaces and a first and a second opposite sides;

an attachment device located on said main body upper surface, for removable attachment of said bracket to the rail so that said main body first and second sides be located on opposite longitudinal sides of the rail;

a load-bearing surface integral to said main body and laterally extending beyond said first side thereof, for supporting the first ceiling tile;

a movable load-bearing finger; and a mounting device attaching said movable finger to said bracket main body and allowing relative displacement of said finger between an inoperative position, in which said finger laterally extends short of said main body second side, and an operative supporting position, in which said finger laterally extends beyond said second side for supporting the second ceiling tile.

2. A bracket as defined in claim 1, further comprising:

a first biasing device mounted on said main body, for continuously biasing said finger towards said operative position;

a catch mounted on said main body and movable between a first position in which said catch engages and prevents said finger from moving towards its said operative position, and a second position in which said catch allows said finger to be moved towards its said operative position under the bias of said first biasing device;

a second biasing device mounted on said main body and continuously biasing said catch towards its said first position;

whereby said catch can be forcibly moved from its first position to its second position against the bias of said second biasing device, for releasing said finger into a displacement towards its operative position.

3. A bracket for removable attachment to an elongated fixed ceiling rail having opposite longitudinal sides and for supporting the edges of a first and a second adjacent ceiling tiles, said bracket comprising:

a main body having opposite upper and lower surfaces and defining a first and a second opposite sides;

an attachment device located on said main body upper surface, for removable attachment of said bracket to the rail so that said main body first and second sides be located on opposite longitudinal sides of the rail;

a load-bearing surface integral to said main body and laterally extending beyond said first side thereof, for supporting the first ceiling tile;

a pivotable load-bearing finger coplanar with said load-bearing surface and pivotable on said main body between an inoperative position, in which said finger laterally extends short of said main body second side, and an operative supporting position, in which said finger laterally extends beyond said main body second side for supporting the second ceiling tile;

a first biasing device mounted on said main body and continuously biasing said finger towards its operative position;

a catch mounted on said main body and movable between a first position in which said catch engages and prevents said finger from moving towards its said operative position and a second position in which said catch allows said finger to be moved towards its said operative position under the bias of said biasing device; and a second biasing device mounted on said main body and continuously biasing said catch towards its said first position;

whereby said catch can be forcibly moved from its first position to its second position against the bias of said second biasing device, for releasing said finger into a pivotal displacement towards its operative position under the bias of said first biasing device.

4. A bracket as defined in claim 3, wherein said main body defines first and second ends substantially perpendicular to said first and second sides, said upper surface being flat and said attachment device comprising a first and a second upwardly oriented resilient lips located on said upper surface on opposite sides and at opposite ends of said main body, said lips defining with said upper surface inwardly oriented slots which allow said bracket to be flatly rotated and resiliently snapped onto the rail which is equipped with lower flat side legs.

5. A bracket as defined in claim 3, wherein said load-bearing surface comprises a pair of spaced-apart laterally projecting fingers fixedly attached to said main body and downwardly depending therefrom, said fingers each defining a flat upper surface coplanar with the upper surface of the other said finger.

6. A bracket as defined in claim 3, wherein said first biasing device is a coil spring mounted on said main body and attached to said pivotable finger for biasing same towards its said operative position.

7. A bracket as defined in claim 3, wherein said catch and said second biasing device are a resilient blade defining a first end mounted on said main body, and a second end laterally extending beyond said main body second side, said blade having a notch thereon for preventing said pivotable finger from being pivoted into its operative position, said blade being resiliently forcibly movable against its own resiliency towards its second position to release said finger into pivotal displacement towards its said operative position.

8. A bracket as defined in claim 6, wherein said catch and said second biasing device are a resilient blade defining a first end mounted on said main body, and a second end laterally extending beyond said main body second side, said blade having a notch thereon for preventing said pivotable finger from being pivoted into its operative position, said blade being resiliently forcibly movable against its own resiliency towards its second position to release said finger into pivotal displacement towards its said operative position.

9. A bracket as defined in claim 8, wherein said blade comprises an upwardly outwardly inclined surface located outwardly of said notch, whereby said pivotable finger can be forcibly pivoted against the bias of said coil spring into its inoperative position, said pivotable finger slidingly engaging said blade inclined surface to move same towards its second position and allow passage of said pivotable finger into its said inoperative position, said finger then clearing said notch whereby said blade moves under the bias of its own resiliency into its first position and said notch prevents said pivotable finger from being released towards its said operative position under the bias of said coil spring.

10. A bracket as defined in claim 9, wherein said pivotable finger defines a pivotal axis and comprises an axial bore having an inner configuration complementary to a selected conventional screwdriver configuration.

11. A bracket as defined in claim 3, wherein said main body comprises an abutment surface on which said pivotable finger abuts in its operative position.

12. A bracket as defined in claim 3, wherein the side edges of the ceiling tiles to be supported by said bracket have C-shaped frame portions attached thereover, said bracket main body further comprising a visual marker for visually indicating the direction of said pivotable finger when it is oriented in its said operative position, thus allowing visual confirmation of the said direction when the tiles partly hide said pivotable finger.

13. A bracket as defined in claim 3, wherein said main body further comprises a lateral abutment surface on each one of said first and second sides for lateral abutment thereagainst of the first and second tiles.

* * * * *